US009468290B2

(12) United States Patent
Roth

(10) Patent No.: US 9,468,290 B2
(45) Date of Patent: Oct. 18, 2016

(54) FOLDABLE LECTERN ASSEMBLY

(71) Applicant: Jacob Roth, Brooklyn, NY (US)

(72) Inventor: Jacob Roth, Brooklyn, NY (US)

( * ) Notice: Subject to any disclaimer, the term of this patent is extended or adjusted under 35 U.S.C. 154(b) by 103 days.

(21) Appl. No.: 13/955,326

(22) Filed: Jul. 31, 2013

(65) Prior Publication Data

US 2015/0034793 A1 Feb. 5, 2015

(51) Int. Cl.

| | |
|---|---|
| ***A47B 19/00*** | (2006.01) |
| ***A47B 23/00*** | (2006.01) |
| ***A47B 97/00*** | (2006.01) |
| ***A47B 19/06*** | (2006.01) |
| *A47B 23/04* | (2006.01) |
| *A47B 97/08* | (2006.01) |
| *A47B 19/08* | (2006.01) |

(52) U.S. Cl.

CPC ..... *A47B 23/001* (2013.01); *A47B 19/06* (2013.01); *A47B 19/08* (2013.01); *A47B 97/08* (2013.01); *A47B 2023/049* (2013.01)

(58) Field of Classification Search

CPC .. A47B 23/001; A47B 23/043; A47B 23/04; A47B 2023/049; A47B 97/08; A47B 97/04; A47B 19/08

USPC ..... 248/441.1, 456, 459–460, 465.1, 188.6, 248/188.8, 371; 108/9, 157.1, 108.25, 27, 108/43, 156, 108, 162; 206/45.23, 45.24, 206/320, 576, 755

See application file for complete search history.

(56) References Cited

U.S. PATENT DOCUMENTS

| | | | | |
|---|---|---|---|---|
| 4,196,674 | A * | 4/1980 | Van Laarhoven | 108/4 |
| 4,555,128 | A * | 11/1985 | White et al. | 281/45 |
| D360,776 | S * | 8/1995 | Blue | D6/406.6 |
| 5,660,117 | A * | 8/1997 | Noble | 108/35 |
| D624,922 | S * | 10/2010 | Hui et al. | D14/447 |
| 8,205,561 | B1 * | 6/2012 | Bierworth | 108/9 |
| 8,322,292 | B2 * | 12/2012 | Chen | 108/43 |
| 8,567,740 | B2 * | 10/2013 | Tarnutzer et al. | 248/456 |
| 2002/0063072 | A1 * | 5/2002 | Pham | 206/320 |
| 2006/0192070 | A1 * | 8/2006 | Chan | 248/371 |
| 2008/0149802 | A1 * | 6/2008 | Chiang | 248/461 |
| 2009/0179132 | A1 * | 7/2009 | Qin et al. | 248/371 |

* cited by examiner

*Primary Examiner* — Tan Le

(74) *Attorney, Agent, or Firm* — Dekel Patent Ltd.; David Klein

(57) ABSTRACT

A foldable lectern assembly includes a reading material support surface pivotedly connected to a case. A support bar is arranged to support the reading material support surface in inclined and horizontal positions. The foldable lectern assembly has a table top configuration and a standup configuration.

12 Claims, 2 Drawing Sheets

FOLDABLE LECTERN ASSEMBLY

FIELD OF THE INVENTION

The present invention relates generally to lecterns for supporting reading material thereupon, and more specifically to a combination foldable and separable lectern that may be selectively configured as a standup lectern assembly or a table top lectern assembly, and is lightweight, and easy to transport, setup and store.

BACKGROUND OF THE INVENTION

Lecterns are commonly used to provide a supporting surface for books, documents and papers for studying purposes, speeches, presentations, and the like. Some lecterns are suitable to be used by a person standing while others are meant for placing on a table and the like.

Foldable lecterns are known in the art. For example, U.S. Pat. No. 6,325,343 to Flagg describes a combination foldable and separable lectern apparatus, which comprises at least seven foam panels.

U.S. Pat. No. 5,044,595 to Carr describes a collapsible podium utilizing laterally pliable, yet longitudinally rigid panels. The panels are inserted into curved slots in the top, bottom and middle portions. A slotted top and bottom portion is required in each configuration.

U.S. Pat. No. 4,618,120 to Wattles describes a portable tabletop lectern having four side panels. The side panels are slidably received in joining strips. To breakdown, all the pieces are separated.

U.S. Pat. No. 3,056,230 to Brokaw Jr., describes a portable tabletop lectern having four foldable portions, with the top inclined portion comprising multiple sheets, which may be folded to suspend over the back portion.

SUMMARY OF THE INVENTION

The present invention seeks to provide an improved foldable lectern assembly, as described more in detail hereinbelow.

There is thus provided in accordance with an embodiment of the present invention a foldable lectern assembly including a reading material support surface including a ledge and being pivotedly connected to a case, a support bar connectable to the reading material support surface and to a portion of the case, wherein the support bar is arranged to support the reading material support surface in inclined and horizontal positions, and in the inclined position an inner volume of the case is open and exposed, support legs disposed in the inner volume of the case and deployable out of the case, and an upright leg assembly including first and second telescoping leg members extending from a common base member which includes a foot rest, the case being removably attachable to the upright leg assembly, the foldable lectern assembly having a table top configuration wherein the foldable lectern assembly is supported by a bottom surface of the case or by the support legs, and the foldable lectern assembly having a standup configuration wherein the foldable lectern assembly is supported by the upright leg assembly.

In accordance with an embodiment of the present invention a carrying handle is attached to a portion of the reading material support surface or the case.

In accordance with an embodiment of the present invention the upright leg assembly is storable in the case.

In accordance with an embodiment of the present invention the support legs include wireframe legs.

In accordance with an embodiment of the present invention the support bar is adjustably mounted in a pair of multi-slot members disposed on opposite sides of the inner volume of the case.

In accordance with an embodiment of the present invention there is a latch for latching the reading material support surface to the case.

In accordance with an embodiment of the present invention there are different sized sets of the support legs.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS

Reference is now made to FIGS. 1A-4B, which illustrate a lectern assembly 10, constructed and operative in accordance with a non-limiting embodiment of the present invention.

Figure 1A:
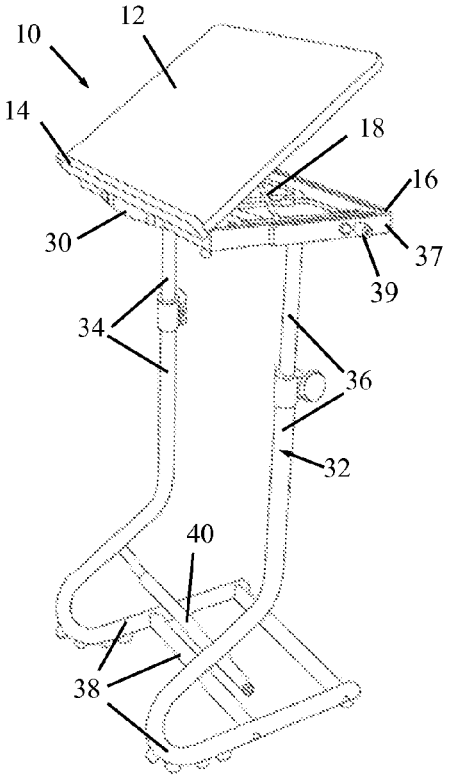
FIGS. 1A and 1B are simplified pictorial illustrations of a lectern assembly configured as a standup lectern assembly, with a reading material support surface in inclined and horizontal positions, respectively, constructed and operative in accordance with a non-limiting embodiment of the present invention.
Figure 1B:
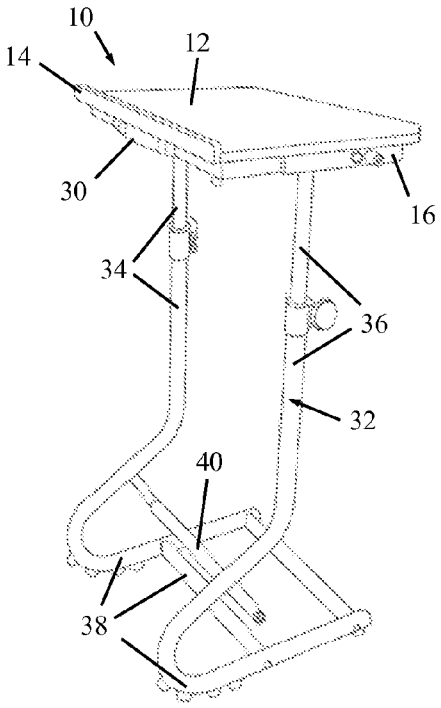

The foldable lectern assembly 10 includes a reading material support surface 12 with a ledge 14. The reading material support surface 12 is pivotedly connected to a case 16. A support bar 18 is connectable to the reading material support surface 12 and to a portion of the case 16. The support bar 18 can support the reading material support surface 12 in an inclined position (FIGS. 1A, 3A, 4A and 4B) and in a horizontal position (FIG. 1B).

In the inclined position, an inner volume of the case 16 is open and exposed. As seen in FIGS. 2, 3A, 4A and 4B, support legs 20 are disposed in the inner volume of the case 16. The lectern assembly 10 has a table top configuration, shown in FIGS. 3A, 4A and 4B. In the table top configuration, the foldable lectern assembly 10 is supported by a bottom surface of the case 16 (FIG. 3A) or by the support legs 20 (FIGS. 4A and 4B) deployed out of case 16. As seen in the illustrated embodiment, the support legs 20 are wireframe legs, and there are different sized sets of the support legs, such as shorter legs 20 and longer legs 20L. In FIG. 4A, the shorter legs 20 support the assembly 10, whereas in FIG. 4B, the longer legs 20L support assembly 10. All the support legs may be provided with rubber grommets 48, which are non-slip and protect the surface upon which the lectern assembly 10 sits from scratches and the like.

Figure 3B:
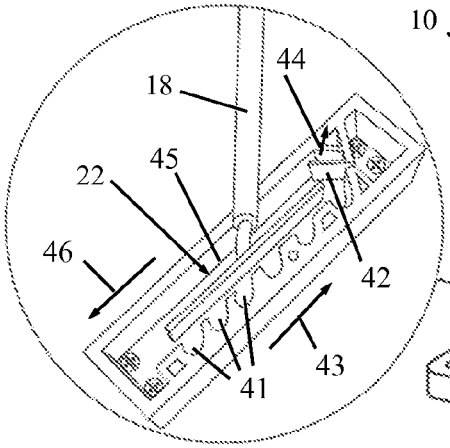
FIG. 3B is an enlarged illustration of a portion of the lectern assembly, showing a multi-slot member for receiving a support bar for the reading material support surface.
Figure 3A:
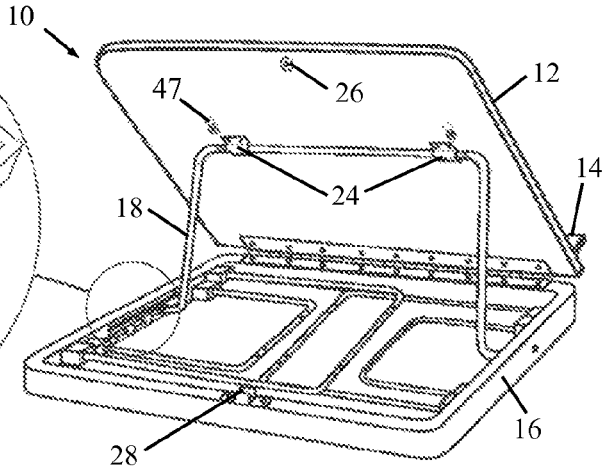
FIG. 3A is a simplified pictorial illustration of the lectern assembly configured as a table top lectern assembly, in accordance with a non-limiting embodiment of the present invention.
Figure 4A:
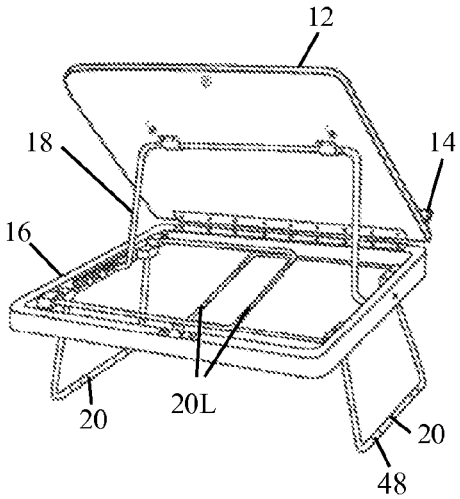
FIGS. 4A and 4B are simplified pictorial illustrations of the lectern assembly configured as a table top lectern assembly, in two different height configurations.
Figure 4B:
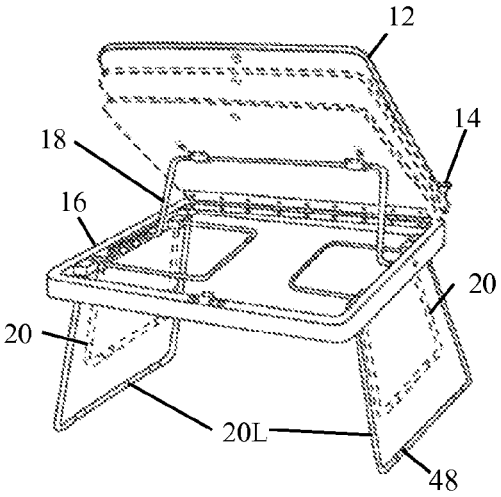

As seen in FIGS. 3A and 3B, legs of the support bar 18 are adjustably mounted in a pair of multi-slot members 22 disposed on opposite sides of the inner volume of the case 16, and a horizontal portion of the support bar 18 may be pivotally attached to the underside of reading material support surface 12 with fasteners 24. As seen in FIG. 4B, the reading material support surface 12 may be adjusted to different inclined positions by adjusting the position of the legs of the support bar 18 in multi-slot members 22. It is noted that in the illustrated embodiment support bar 18 has two legs but the invention can also be carried out with just one leg (e.g., a central leg) in one multi-slot member 22.

Referring particularly to FIG. 3B, the present invention provides a simple method of adjusting the legs of the support bar 18 in each of the multi-slot members 22. The multi-slot member 22 has a row of slots 41 in which the support bar 18 can be received. At one end of the row of slots 41 there is a resilient tongue 42 towards which the support bar 18 can be slid. If the user wishes to move the support bar 18 back to the first slot at the opposite end of the row, the user simply pushes support bar 18 against tongue 42 in the direction of arrow 43. The tongue 42 gives way and bends back in the direction of arrow 44. This allows moving the support bar 18 to a smooth channel 45, substantially parallel to the row of slots 41. Now the user can quickly move support bar 18 in the direction of arrow 46 back to the first slot at the beginning of the row of slots 41. The fasteners 24 that support the horizontal portion of the support bar 18 may be provided with biasing devices 47, such as coil springs, to help push the legs of the support bar 18 into channel 45 after pushing against tongue 42. The biasing devices 47 may be alternatively placed in other places, such as at the hinge between the surface 12 and the case 16.

Figure 2:
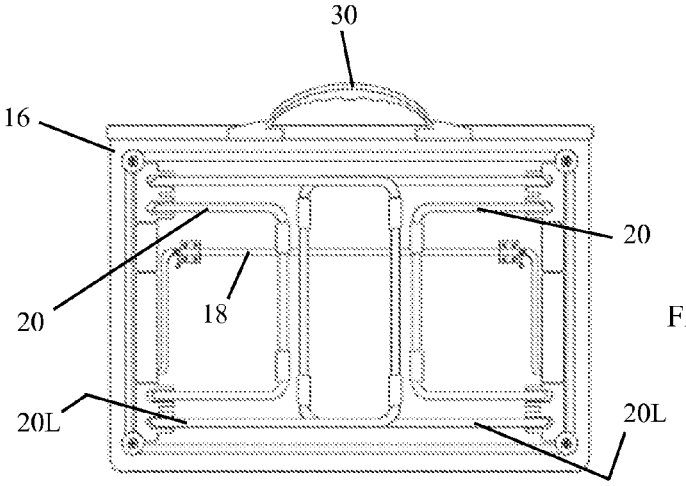
FIG. 2 is a simplified illustration of the lectern assembly folded and stored in a carrying case.

As seen in FIG. 3A, a latch that includes a pair of latch members 26 and 28 may be provided for latching the reading material support surface 12 to the case 16. Without limitation, latch members 26 and 28 may be magnetic or snaps or others. As seen in FIGS. 1A, 1B and 2, a carrying handle 30 is attached to a portion of the reading material support surface 12 or the case 16.

The foldable lectern assembly 10 has a standup configuration, shown in FIGS. 1A and 1B. In the standup configuration, foldable lectern assembly 10 is supported by an upright leg assembly 32. The upright leg assembly 32 includes first and second telescoping leg members 34 and 36, which extend upwards from a common base member 38 which includes a foot rest 40. The case 16 is removably attachable to an upper frame 37 at an upper portion of the upright leg assembly 32, such as by means of fasteners 39 (which may be without limitation, thumbscrews, pins, dowels, etc.). In accordance with an embodiment of the present invention the upright leg assembly 32 is storable in the case 16.

What is claimed is:

1. A foldable lectern assembly comprising:

a reading material support surface comprising a ledge and being pivotedly connected to a case;

a support bar connectable to said reading material support surface and to a portion of said case, wherein said support bar is arranged to support said reading material support surface in inclined and horizontal positions; and a multi-slot member comprising a row of slots in which the leg of said support bar is placeable, wherein at one end of the row of slots there is a resilient tongue and the leg of said support bar is moveable past said tongue to a channel, and the leg of said support bar is movable along said channel to an opposite end of the row.

2. The assembly according to claim 1, wherein in the inclined position of said reading material support surface an inner volume of said case is open and exposed.

3. The assembly according to claim 1, wherein support legs are disposed in an inner volume of said case and deployable out of said case.

4. The assembly according to claim 3, further comprising an upright leg assembly comprising first and second telescoping leg members extending from a common base member which comprises a foot rest, said case being removably attachable to said upright leg assembly, said foldable lectern assembly having a table top configuration wherein said foldable lectern assembly is supported by a bottom surface of said case or by said support legs, and said foldable lectern assembly having a standup configuration wherein said foldable lectern assembly is supported by said upright leg assembly.

5. The assembly according to claim 1, wherein a carrying handle is attached to a portion of said reading material support surface or said case.

6. The assembly according to claim 4, wherein said upright leg assembly is storable in said case.

7. The assembly according to claim 3, wherein said support legs comprise wireframe legs.

8. The assembly according to claim 1, further comprising a latch for latching said reading material support surface to said case.

9. The assembly according to claim 1, comprising different sized sets of said support legs.

10. The assembly according to claim 1, wherein said row of slots and said channel are both located in a common depression formed in said multi-slot member.

11. The assembly according to claim 10, wherein said row of slots and said channel are separated from each other by a divider that extends parallel to said row of slots.

12. The assembly according to claim 10, wherein the leg of said support bar does not move over said tongue during movement in said channel.

* * * * *